US005110254A

United States Patent [19]

Aubrey

[11] Patent Number: 5,110,254

[45] Date of Patent: May 5, 1992

[54] QUICK-RELEASE COUPLING FOR EARTHWORKING MACHINES

[76] Inventor: Martin J. Aubrey, Westbourne, Kington, Herefordshire HR5 3NL, England

[21] Appl. No.: 519,908

[22] Filed: May 7, 1990

[30] Foreign Application Priority Data

Mar. 7, 1990 [GB] United Kingdom ..... 9005741

[51] Int. Cl.[5] ..... E02F 3/70

[52] U.S. Cl. ..... 414/723; 172/275; 403/24

[58] Field of Search ..... 414/723, 912; 37/117.5; 172/272, 273, 275; 403/325, 322, 321, 24

[56] References Cited

U.S. PATENT DOCUMENTS

| | | | |
|---|---|---|---|
| 3,782,249 | 1/1974 | Drone . | |
| 3,934,738 | 1/1976 | Arnold . | |
| 3,985,249 | 10/1976 | Aker et al. . | |
| 4,127,203 | 11/1978 | Arnold . | |
| 4,136,792 | 1/1979 | Wilson et al. | 37/117.5 X |
| 4,187,050 | 2/1980 | Barbee | 414/723 |
| 4,214,840 | 7/1980 | Beales | 403/322 X |
| 4,243,356 | 1/1981 | Takojima | 414/723 |
| 4,251,181 | 2/1981 | Drott et al. . | |
| 4,279,085 | 7/1981 | Arnold . | |
| 4,311,428 | 1/1982 | Arnold . | |
| 4,345,872 | 8/1982 | Arnold . | |
| 4,417,844 | 11/1983 | de Pingon | 414/723 |
| 4,457,085 | 7/1984 | Arnold . | |
| 4,586,867 | 7/1986 | Stafford . | |
| 4,787,237 | 11/1988 | Houston et al. . | |
| 4,824,319 | 4/1989 | Arnold . | |
| 4,833,760 | 5/1989 | Sundström | 403/322 X |
| 4,850,790 | 7/1989 | Johnson et al. . | |
| 4,955,779 | 9/1990 | Knackstedt | 414/723 |

FOREIGN PATENT DOCUMENTS

| | | | |
|---|---|---|---|
| 0052987 | 6/1982 | European Pat. Off. . | |
| 0143074 | 5/1985 | European Pat. Off. . | |
| 0184282 | 6/1986 | European Pat. Off. . | |
| 0273828 | 7/1988 | European Pat. Off. . | |
| 0065639 | 5/1980 | Japan | 414/723 |
| 1021722 | 6/1983 | U.S.S.R. | 414/723 |
| 1492504 | 11/1977 | United Kingdom . | |
| 2120634 | 12/1983 | United Kingdom . | |
| 2169582A | 7/1986 | United Kingdom . | |
| 2172045 | 9/1986 | United Kingdom . | |
| 2205299A | 12/1988 | United Kingdom . | |
| 2208220A | 3/1989 | United Kingdom . | |
| WO88/03198 | 5/1988 | World Int. Prop. O. . | |

*Primary Examiner*—Frank E. Werner
*Assistant Examiner*—James T. Eller
*Attorney, Agent, or Firm*—Oliff & Berridge

[57] ABSTRACT

A coupling is used for releasably connecting tools to the articulated arm of excavators and other heavy duty equipment. The coupling includes a first coupling member, a second coupling member, a locking member provided on the first coupling member and movable between lock and release positions, a spring arranged between the first coupling member and the locking member for urging the locking member into the lock position, and a hydraulically operated release mechanism provided on the first coupling member for moving the locking member into the release position in opposition to the force of the spring. Hydraulic fluid at a pressure relief pressure level is applied through a first non-return valve to release the locking member and permit detachment of one tool and attachment of another tool; the pressurized hydraulic fluid is then returned through a second non-return valve to return the locking member into the lock position, thereby retaining the newly attached tool under pressure of the spring.

11 Claims, 5 Drawing Sheets

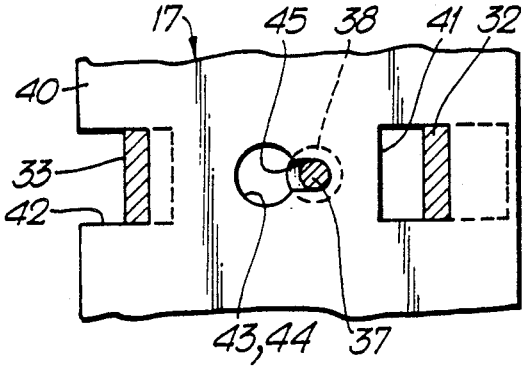
Fig. 3.
Fig. 4.
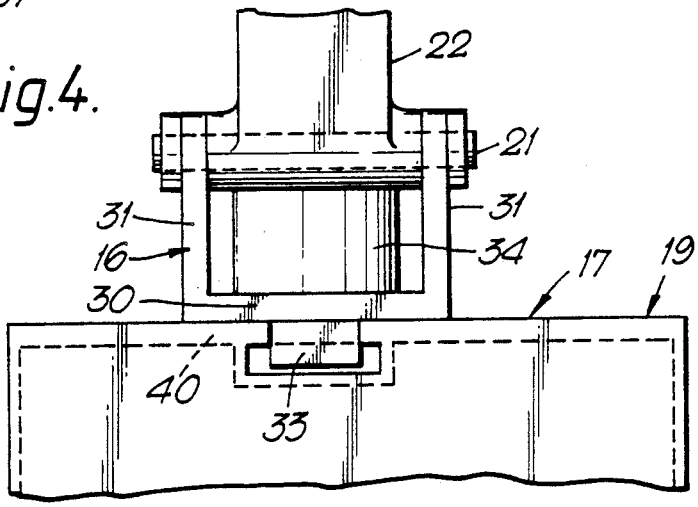
Fig. 5.
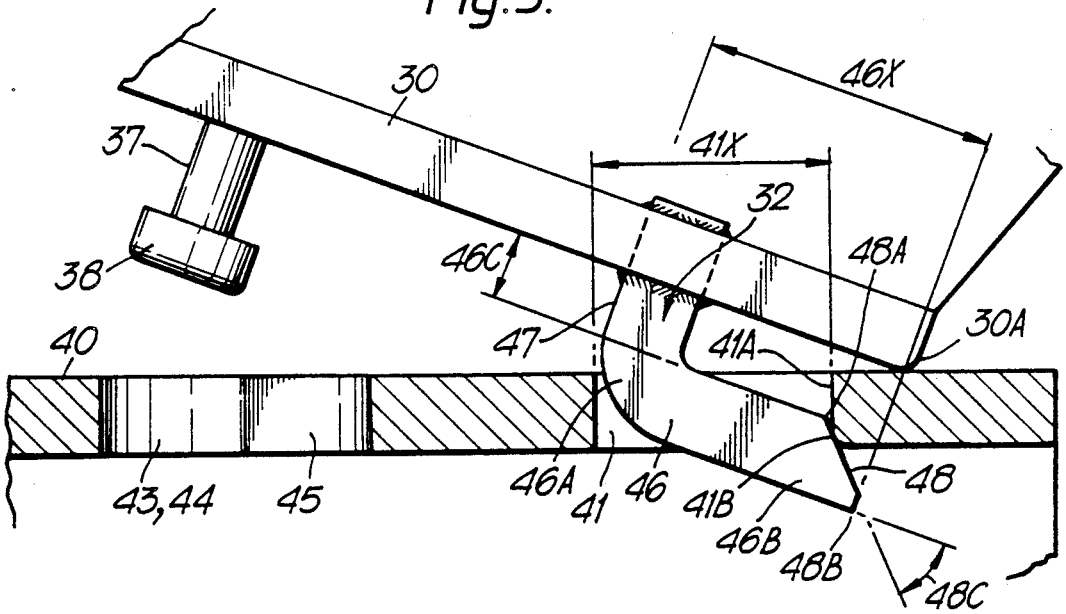

29
49
50
53
52
53A
65
54B
55
56
54A
58D
27
25
28
58
24
58E
23
20
13A
58A
58B
13
22
58C
58F
35
16
38
21
39
36
31
34
30
62A
59A 31
30
45
37
32A
42A
33A
32B
43,44
38
19
40
31

QUICK-RELEASE COUPLING FOR EARTHWORKING MACHINES

BACKGROUND OF THE INVENTION

This invention relates to a coupling for use in a machine having an articulated arm and wherein the coupling is required for releasably connecting a tool to the arm. The machine may be a vehicle on which the arm is mounted and the tool may be a tool for excavating soil or otherwise working the ground.

The invention also relates to the machine itself as adapted for operation of the coupling.

Further the invention relates to a method of operating the machine for the purpose of facilitating the operation of the coupling.

Efforts have been made to develop a coupling for use in releasably connecting tools to the articulated arm of excavators and the like. However, prior couplings have failed for a number of reasons, including lack of reliability, lack of adequate safety, or because they are unduly complicated or time consuming in their operation (in some cases, for example, requiring the machine operator to dismount, mechanically remove pins, and remount).

Thus, despite repeated efforts there remained a need for a coupling which would overcome the foregoing disadvantages.

SUMMARY OF THE INVENTION

Accordingly, the present invention has been developed to overcome the foregoing problems.

It is an object of the present invention to provide a coupling which will withstand repeated tool changes and rough usage on heavy duty excavators and the like.

It is another object of the present invention to provide a coupling which will safely maintain the attachment of tools to the articulated arms of excavators and the like during such rough, heavy duty usage.

It is yet another object of the present invention to provide a coupling by which tools can be easily and quickly attached to and detached from excavators and the like, without the necessity for an operator to dismount and remount the machine.

Thus, one aspect of the present invention is a coupling which comprises a first coupling member; a second coupling member; a locking member provided on the first coupling member and movable between a lock position and a release position; a spring arranged between the first coupling member and the locking member for urging the locking member into the lock position; and release means provided on the first coupling member for moving the locking member into the release position in opposition to the force of the spring.

In accordance with another aspect of the present invention, the coupling further comprises a support structure on which the first coupling member is supported for movement between a terminal position and an operational position; operating means for moving the first coupling member between the terminal and operational positions; and control means for effecting movement of the locking member into the release position responsive to the first coupling member attaining the terminal position.

In accordance with yet another aspect of the present invention, the coupling further comprises a latch for retaining the locking member in the release position in opposition to the force of the spring; and latch operating means for withdrawing the latch so that the spring can return the locking member into the lock position.

In accordance with still another aspect of the present invention, the coupling further comprises a source of fluid pressure; the release means comprises a hydraulic motor; the latch comprises a first non-return valve arranged to allow fluid flow between the source and the hydraulic motor only in a direction toward the hydraulic motor so as to move the locking member into the release position and prevent return of the locking member into the lock position; and the latch operating means comprises a second non-return valve arranged to allow fluid flow only away from the hydraulic motor so that any rise in the fluid pressure cannot act on the motor in the sense of moving the locking member into the release position.

In accordance with a further aspect of the present invention, the operating means comprises a first hydraulic motor; and the release means comprises a second hydraulic motor adapted to move the locking member into the release position responsive to fluid pressure in the first hydraulic motor exceeding a predetermined value.

In accordance with an even further aspect of the present invention, the first hydraulic motor comprises a cylinder containing a piston movable therein between terminal positions, the first hydraulic motor is connected in a hydraulic circuit containing a pressure relief valve; and the predetermined value is reached when the piston attains one of the terminal positions.

Still further aspects of the present invention include an earthworking machine equipped with the coupling, a method of operating the coupling, and a method of changing tools on the earthworking machine equipped with the coupling.

These and other aspects and advantages of the present invention are described in or apparent from the following detailed description of the preferred embodiments.

BRIEF DESCRIPTION OF THE DRAWINGS

A coupling, machine and methods according to the invention will now be described, by way of example, with reference to the accompanying drawings wherein:

FIG. 3 is a section on the line III—III in FIG. 2.

FIG. 4 is a view on the line IV—IV in FIG. 2.

FIG. 5 is a further enlarged detail of FIG. 2 and shows a part of the coupling in a partly engaged condition.

DESCRIPTION OF THE PREFERRED EMBODIMENTS

General Arrangement

Figure 1:
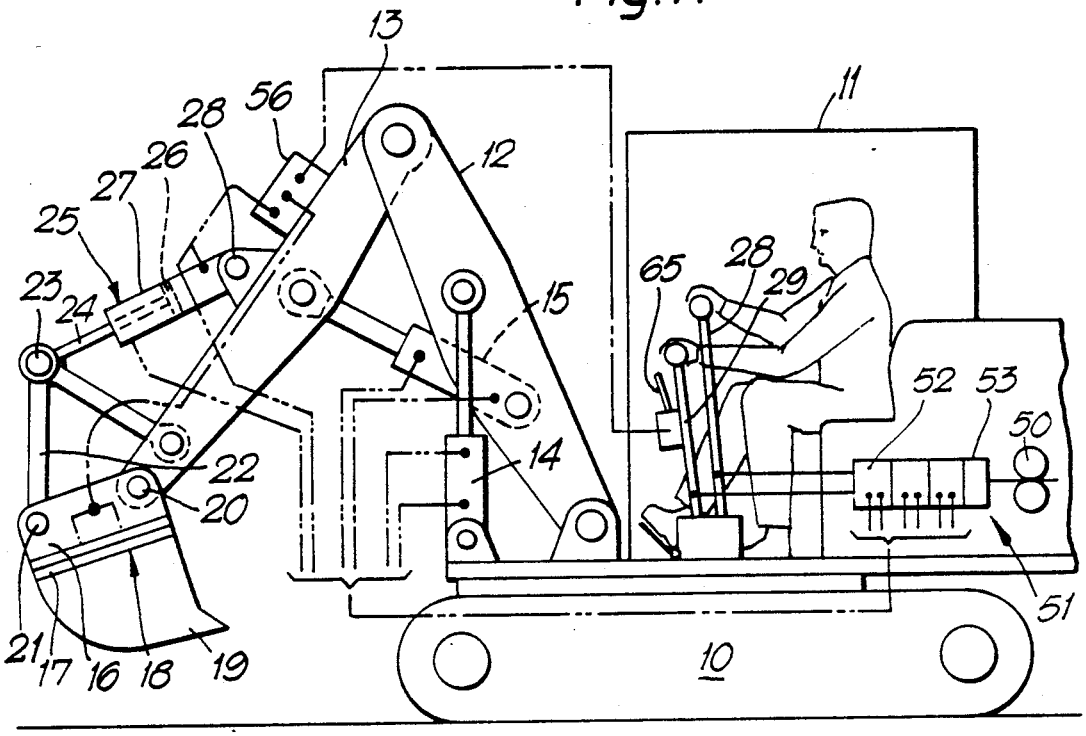
FIG. 1 is an elevation of the machine.

Referring to FIG. 1, the excavating machine comprises a chassis 10, an operator cab 11 and a boom 12 pivotally connected at one end to the chassis 10 and supporting a pivoted arm 13 at its other end. The boom 12 and arm 13 lie in a common plane and can be operated, i.e. raised, lowered, extended or contracted within said plane and relative to the chassis 10 by linear hydraulic motors 14, 15. At the free or rear end of the arm 13 there is provided a first member 16 of a coupling 18 for connecting a bucket 19 to the arm 13, a second member 17 of the coupling being provided on the bucket itself. The coupling member 16 has one end connected to the free end of the arm 13 by a front pivot 20 and another end connected in succession by a rear pivot 21, a link 22, a pivot 23 and a rod 24 to a hydraulic motor 25 comprising a piston 26 and a cylinder 27 mounted on the arm 13 by a pivot 28. The arrangement is such that operation of the motor 25 pivots the coupling member 16 about the pivot 20.

The cab 11 includes an operating lever 28 for operating the motors 14, 15 and an operating lever 29 for operating the motor 25. The drawing shows the bucket 19 as connected to the arm 13 by the coupling 18.

The Coupling

Figure 2:
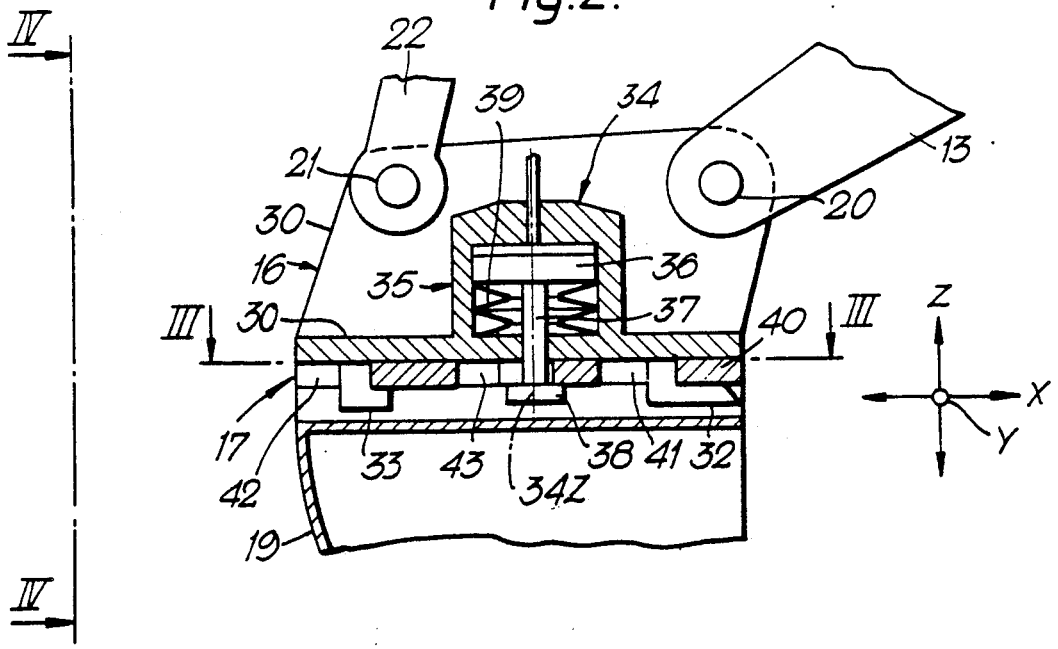
FIG. 2 is an enlarged detail of FIG. 1 and shows the coupling in the fully engaged condition.

Referring to FIGS. 2 to 4, the coupling 18 is described with reference to mutually perpendicular directions X, Y, Z wherein the directions X and Z lie in the common plane of the boom and arm 12, 13. The terms "front" and "rear" are used for aspects of the coupling respectively near to and remote from the cab 11. The terms "forward" and "rearwards" are used to indicate movement in directions respectively toward and away from the cab 11.

The coupling member 16 comprises a pair of side plates 31 which contain the pivots 20, 21 and which are secured to a base plate 30 (which lies in the directions X, Y). The base plate 30 includes a front hook 32 and a rear hook 33 both secured to what is regarded as the underside of this plate. The hooks 32, 33 are spaced apart in the direction X. The member 16 further includes a hydraulic motor 34 comprising a cylinder 35 and a piston 36 provided at the other or upper side of the plate 30. The motor 34 is positioned intermediate between the hooks 32, 33 and so that the axis, 34Z, of the cylinder 35 lies in the direction Z. The piston 36 has secured thereto a circular cross-section pin 37 projecting in the direction of the axis 34Z through the plate 30 to the underside thereof and provided at its end remote from the piston 36 with a head 38 of larger diameter than the pin 37. The piston 36 is urged upwardly by Bellville springs 39 (FIG. 2) so as to bias the head 38 toward the plate 30 into a retracted position. Introduction of hydraulic pressure into the cylinder 35 above the piston 37 urges the latter downwards in opposition to the force of the springs 39 so as to move the head 38 away from the plate 30 into an extended position.

The coupling member 17 which, as mentioned, is secured to the bucket 19, comprises a plate 40 having a front aperture 41, a rear aperture 42, and an intermediate aperture or key hole slot 43, respectively dimensioned for the free passage through the plate 40 of the front hook 32, the rear hook 33 and the head 38. The key hole slot 43 comprises a part 44 wide enough for the passage therethrough of the head 38, and a part 45 whose width is such that it can accommodate the pin 37 but that it does not permit the passage of the head 38.

The front hook 32 and adjacent parts of the plates 30, 40 are dimensioned to satisfy a specific maneuver of engaging the hook 32 with the plate 40 as a preliminary step to passing the head 38 and rear hook 33 through the apertures 43, 42. This maneuver, which is described later hereinbelow, is a particularly useful way of operating the coupling 18. To this end the front hook 32 (FIG. 4) comprises a foot 46 connected at one end or heel 46A to the plate 30 by a stem 47 and provided at the other end or toe 46B with an end surface 48 extending between upper and lower edges 48A, 48B which lie in the direction Y and which are spaced apart obliquely in the directions X and Z such that the upper edge 48A lies rearward of the edge 48B. An acute angle 48C between the surface 48 and the plate 30 is preferably about 45 degrees. The foot 46 is spaced from the plate 30 by a distance 46C which is slightly greater than the thickness of the plate 40.

Further, the plate 30 has an abutment formed by a front edge 30A being an edge extending at the underside of this plate in the direction Y parallel to the edge 48B of the foot end surface 48 and approximately in alignment with the edge 48B in the direction Z. The edge 30A is intended for support of the plate 30 on the plate 40 during operation. The aperture 41 of the plate 40 has a width 41X in the direction X less than the width, 46X, of the foot 46. Further, the aperture 41 has a front end surface 41A which defines, at the underside of the plate 40, an edge 41B extending in the direction Y and defining an abutment about which the surface 48 of the foot 46 can pivot in operation.

The Coupling Maneuver

Connecting the bucket to the machine is performed by a maneuver comprising the following steps:

1. Moving the machine relative to the bucket so that the coupling member 16 is situated above the coupling member 17 of the bucket as standing on the ground. This position is easily achieved by the operator operating the motors 14, 15.

2. Moving the head 38 into the extended position by operating the motor 34. This is more specifically described later hereinbelow with reference to the hydraulic system.

3. Operating the motor 25 to move the member 16 into a position in which the toe 46B of the hook 32 points toward the aperture 41 of the plate 40.

Figure 6:
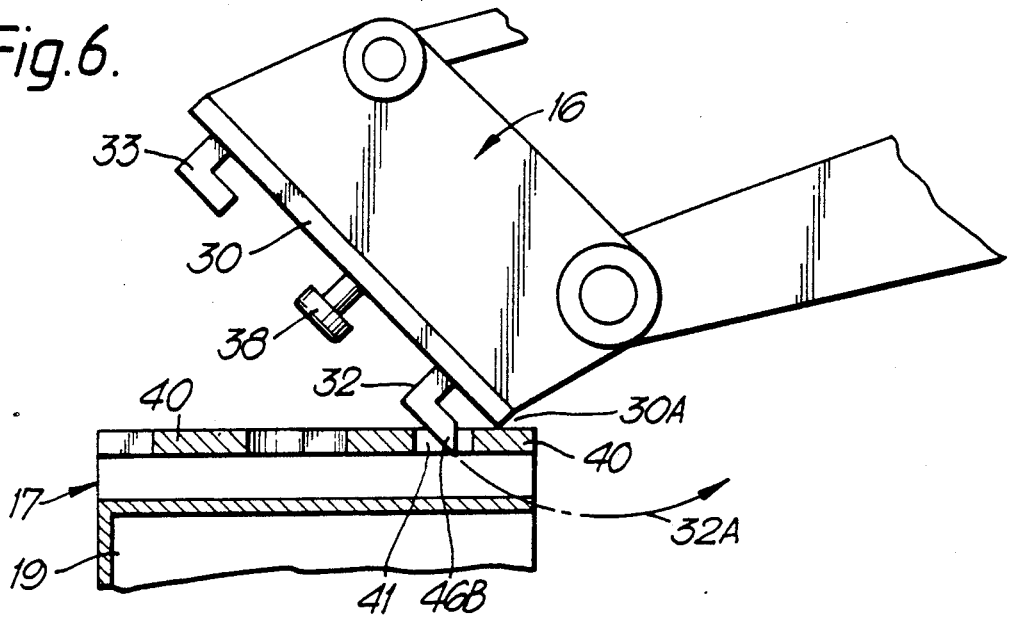
FIGS. 6, 7 and 8 show different stages in the process of engaging the coupling.

4. Operating the motors 14, 15 to lower the member 16 so that the toe 46B enters into the aperture 41, this movement being terminated by the edge 30A abutting the plate 30 (FIG. 6).

5. Operating the motor 25 to tilt the member; 16 forwards thereby to engage the surface 48 of the hook 32 with the edge 41B of the aperture 41 (FIGS. 6, 5). During this movement the hook 32 describes an arc 32A about the pivot 20. Since the bucket 19 rests on the ground, this arcuate movement of the hook may need to be accompanied by a corresponding raising of the arm by operation of the motors 14, 15 to compensate for the downward component of the arcuate movement. Also, it will be noted that the forward component of the arcuate movement causes the bucket to slide along the ground in a forward sense. The resistance of the bucket to such sliding assists in the engagement of the hook 32 with the aperture 41.

Figure 7:
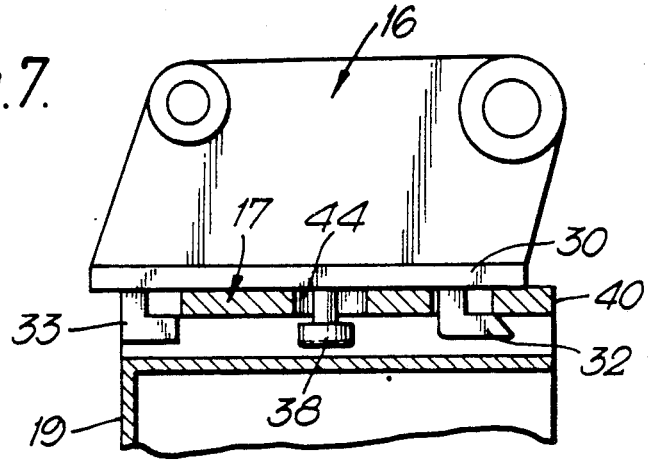

6. Continuing operation of the motor 25 thereby to fully pass the hook 32 through the aperture 41 (FIG. 7). At this stage, the plate 30 lies fully on the plate 40 and the head 38 has passed through the large part 44 of the aperture 43. It will be clear from FIGS. 5 and 6 that the cooperation between the edge 30A and the plate 40, the cooperation between the surface 48 and the edge 41B, and the relative lengths of the distances 41X, 46X, all ensure a smooth passage of the hook 32 through the aperture 41 and also ensure that the head 38 is aligned with the large part 44 of the aperture 43 as the plate 30 is lowered on to the plate 40.

Figure 8:
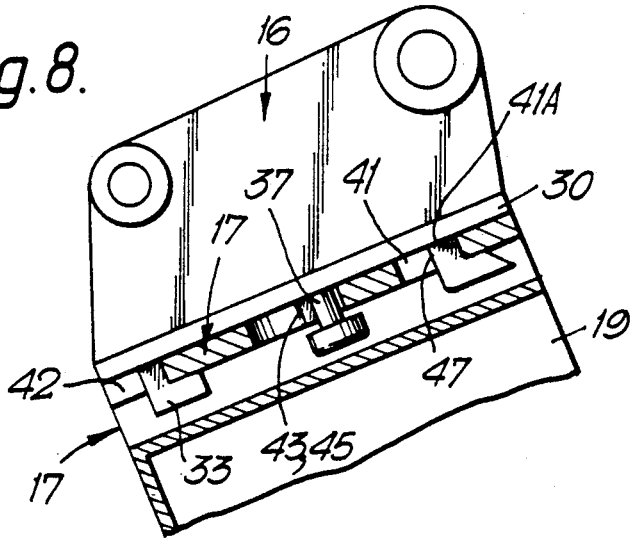

7. Continuing operation of the motor 25 thereby to tilt the plate 30 obliquely forwards and upwards so that the bucket 19 is raised from the ground and tends to slide backwards under gravity, this movement being terminated by engagement between the stem 47 of the hook 32 and the surface 41A of the aperture 41 (FIG. 8). In this position the rear hook 33 engages the rear aperture 42 and the rod 37 engages the narrow part 45 of the slot 43.

8. Retracting the head 38 by operation of the motor 34 thereby to clamp the plate 40 to the plate 30 and secure the bucket 19 to the member 16 by the springs 39. The hooks 32, 33 now serve the purpose of preventing rotation of the bucket 19 about the axis of the rod 37.

The operation of the motor 34 necessary for steps 2 and 8 of the above maneuver will be described next hereinbelow as part of the description of the hydraulic control system.

The Hydraulic Control System

Figure 9:
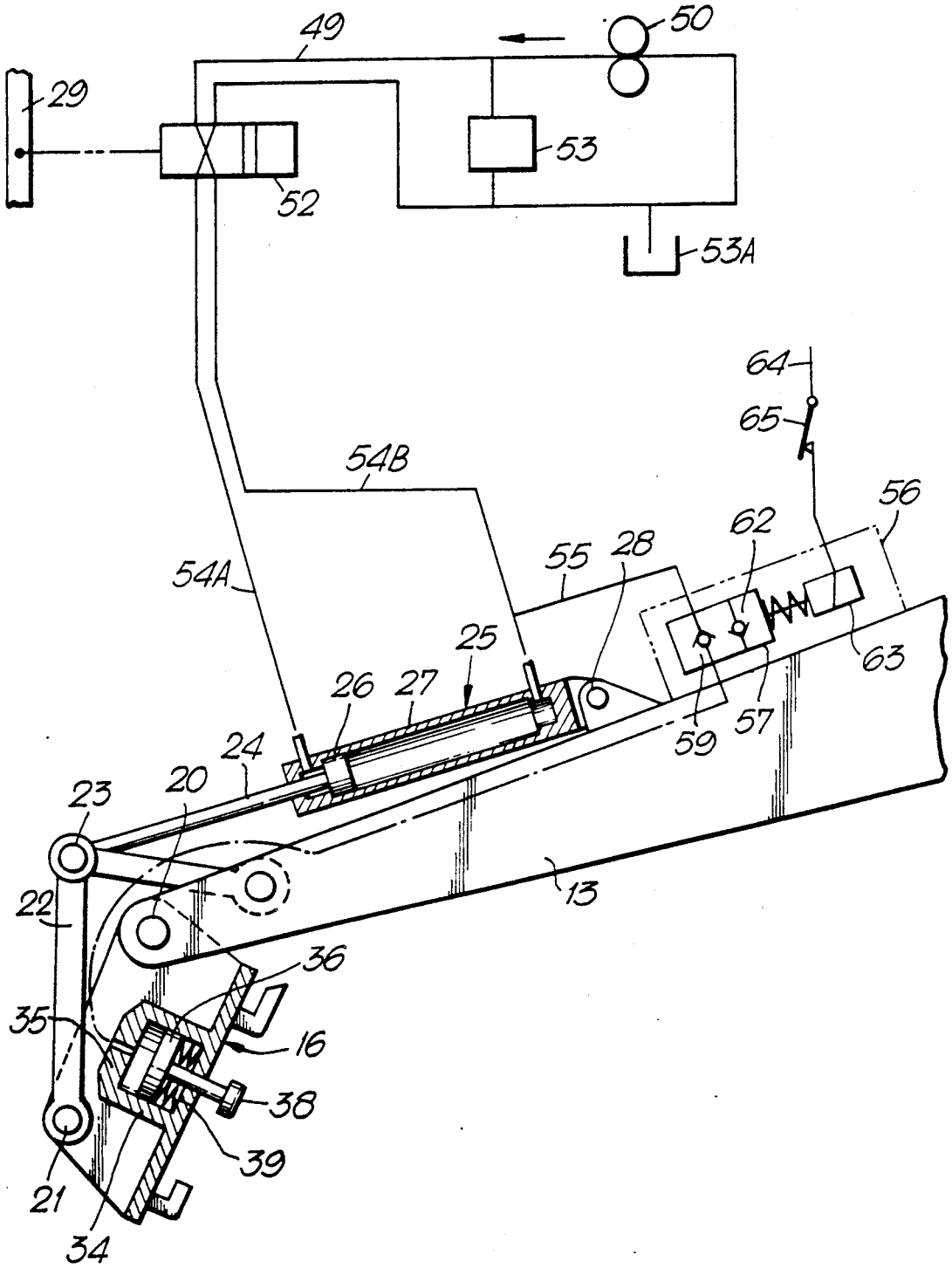
FIG. 9 is a diagram of a hydraulic system for operating the coupling and also shows an associated part of the machine.

Referring to FIGS. 1 and 9, hydraulic pressure is supplied by a pump 50 through a valve group 51 to the motors 14, 15 in a manner known per se and therefore not specifically illustrated. Regarding the motor 25, the pump supply feeds a hydraulic circuit 49 containing a reversing valve 52 forming part of the group 51. The valve 52 is operable by the lever 29 for introducing the supply through lines 54A, 54B to the respective ends of the cylinder 27 for pivoting the coupling member 16 forwards or rearwards. The pump supply is connected through a pressure relief valve 53 to a drain 53A so that when the piston 26 reaches the end of its stroke the pressure in the supply line 54A or 54B, as the case may be, rises to the relief pressure. The line 54A is also connected by a feed line 55 through a control valve 56 to the motor 34.

The valve 56 comprises a valve member 57 containing a first non-return valve 59 arranged to permit flow only toward the motor 34 and a second non-return valve 62 arranged to permit flow only away from the motor 34. The valve 56 is operated by a solenoid 63 arranged in an electric circuit 64 controlled by a switch 65 mounted on the lever 29 (FIG. 1) for actuation by the operator when seated in the cab 11. The normal position of the valve 56 when the switch is open is such that a spring urges the member 57 into a position in which the motor 34 is connected to the line 55 through the non-return valve 62 so that the cylinder 35 can drain under the action of the springs 39 on the piston 36 and the head 38 is held in the retracted position.

If the switch 65 is closed, the solenoid 63 moves the member 57 into a position in which the motor 34 is connected to the line 55 through the non-return valve 62 so that pressure in the line 55 can act on the motor 34 to extend the head 38.

Referring to step 2 of the coupling maneuver, since springs 39 have to be powerful enough to hold the bucket 19 firmly on the member 16, a correspondingly high hydraulic pressure is needed for compressing the springs 39 when the head 38 is to be extended. To this purpose use is made of the highest pressure available on the machine, this being the relief pressure of the valve 53.

More specifically, step 2 of the coupling maneuver comprises two actions. The one action comprises operating the lever 29 to tilt the member 16 forwards to the fullest extent permitted by the cylinder 27 as shown in FIG. 9. On abutment of the piston 26 with the one end of the cylinder 27 the hydraulic pressure rises to the maximum permitted by the relief valve 53. The other action comprises closing the switch 65 to connect this maximum pressure to the motor 34 to extend the head 38. As can be seen in FIG. 1, the valve 56 is mounted on the arm 13 adjacent the motor 25. By using the motor 25 for providing the pressure for the motor 34, there is avoided the need for providing an additional valve in the group 51 (FIG. 1) and an additional high pressure line along the boom 12 and arm 13 to the member 16. This greatly facilitates the installation of the coupling 18 in existing machines.

Regarding step 8 of the coupling maneuver, it will be clear that simply returning the switch 65 to its open position connects the motor 34 to the line 55 through the non-return valve 62. If the pressure in the line 55 should rise to maximum during ordinary operation of the machine, then the valve 62 prevents accidental operation of the motor 34. In this way there is provided a fail-safe retention of the bucket 19 on the member 16.

When the bucket is to be disengaged from the member 16, the motor 25 is operated to move the member 16 into a position wherein the plates 30, 40 are inclined obliquely rearward and upward. Thereafter the switch 65 is closed with the consequence that the head 38 is extended and the bucket is freed to slide forward and downward and pivot about the hook 32 into a position free of the member 16.

Modifications

Figure 10:
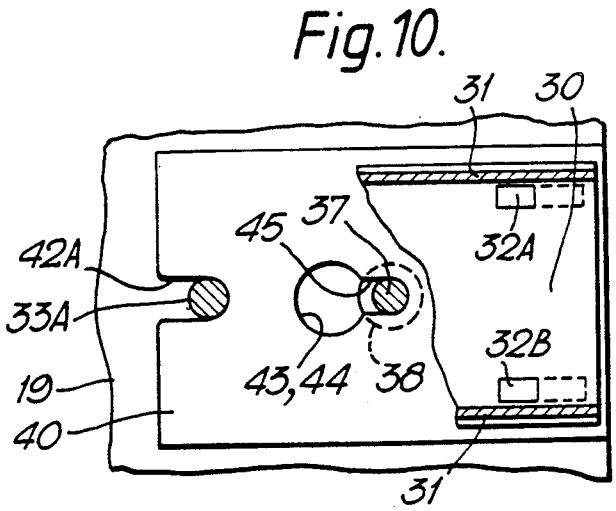
FIG. 10 is a view similar to FIG. 3 but shows a modification.

Regarding the hooks 32, 33, the rear hook 33 may be replaced by a simple pin or stud 33A (FIG. 10) adapted to engage a slot 42A in the plate 40.

Referring to the front hook 32, this is of substantial width as shown in FIG. 3 so as to assist in the pin 37 and head 38 becoming aligned with the wide part 44 of the keyhole slot 43 during the maneuver of engaging the coupling. Instead of being of such width, the front hook may comprise two spaced hook elements 32A, 32B (FIG. 10) provided adjacent the respective side plates 31. Similarly, the rear hook 33 may comprise two such elements or two pins similar to the pin 33A, adjacent the respective side plates 31.

The valve 59 may be connected to the motor 25 by a pipe 58 (FIG. 11) supported over part of its length either on the arm 13 or on the motor 25, a portion 58A of the pipe adjacent the motor 34, or adjacent the pivot 20, being flexible. The portion 58A may be secured at one end to a fitting 58D on the cylinder 27 or, if the pipe 58 is led along the arm 13, to a fitting 58E. The other end, 58B, of the portion 58A may lie adjacent the cylinder 35 close to the plate 30 and terminate at a fitting 58C. A separate pipe, 58F, which may be non-flexible, is provided to connect the end 58B to the cylinder 35. This arrangement provides for a substantial length of the portion 58A to allow for flexing of the portion 58A when the member 16 is pivoted. The portion 58B can be led from the fitting 58D on the cylinder 27, or the fitting 58E on the upper surface 13A of the arm 13, along a path between the side plates 31, to the fitting 58C. This provides for protection of the pipe portion 58A during the severe operating conditions usually encountered with excavations.

Figure 11:
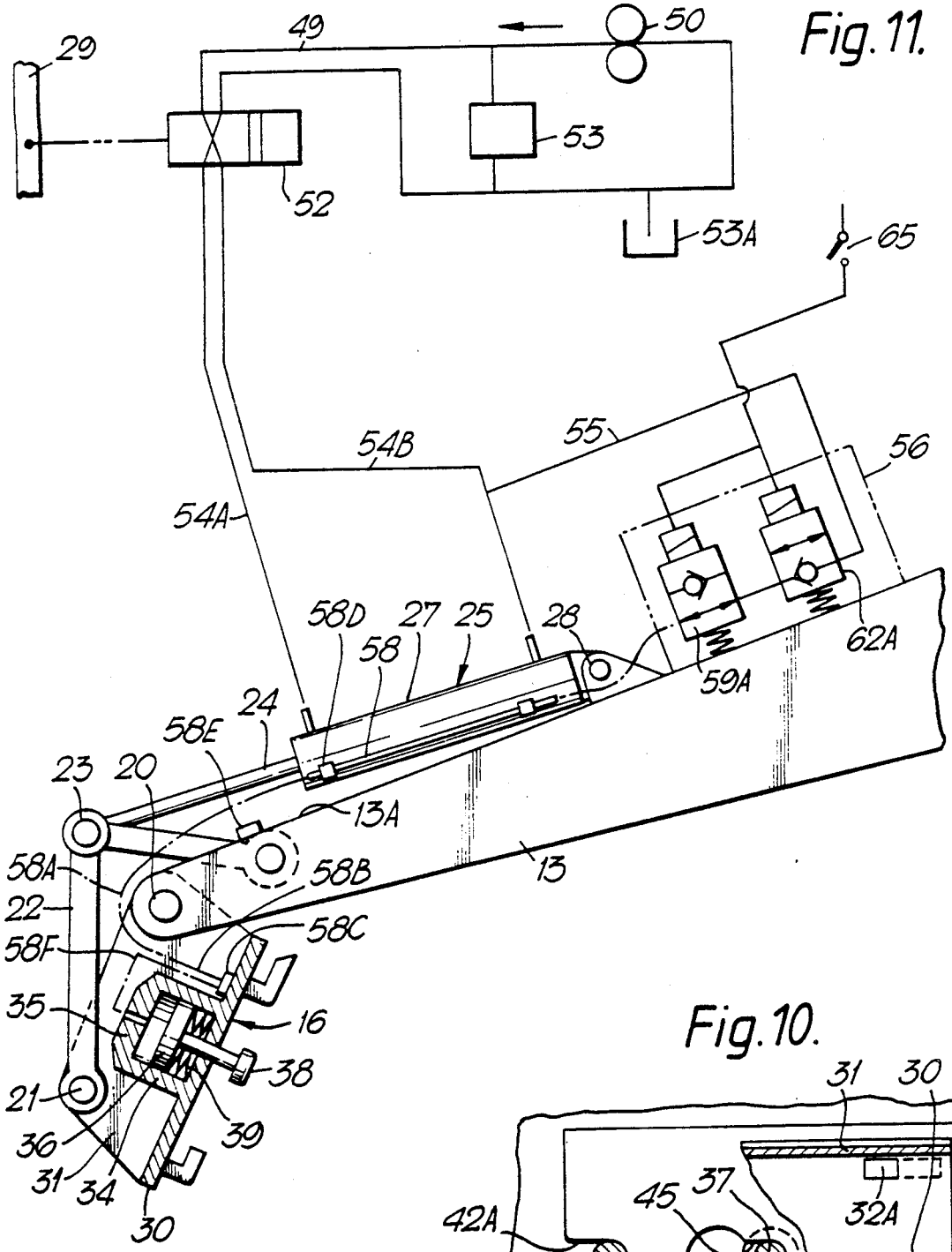
FIG. 11 is a view similar to FIG. 9 but shows a modification.

FIG. 11 also shows the control valve 56 as comprising a normally open non-return valve 59A connected to a normally closed non-return valve 62A such that when the switch 65 is open, flow is permitted only from the cylinder 35 to the line 55. On the other hand, if the switch 65 is closed the valves 59A, 62A adopt a position in which flow is permitted only from the line 55 to the cylinder 35.

Obviously, many modifications and variations to the disclosed embodiments are possible in light of the above teachings. It is therefore to be understood that, within the scope of the appended claims, the invention may be practiced otherwise than as specifically described and that modifications may be made without departing from the spirit and scope of the invention.

What is claimed is:

1. A quick-release coupling for earth-working machines, the coupling comprising:

a first coupling member;

a second coupling member engageable with said first coupling member;

a locking member provided on the first coupling member and movable between a lock position and a release position for respectively locking the second coupling member to the first coupling member and releasing it therefrom;

a spring arranged between the first coupling member and the locking member for urging the locking member into the lock position;

a hydraulic motor arranged between the first coupling member and the locking member for moving the locking member into the release position in opposition to the force of the spring;

a single fluid flow line connected to said motor for the operation thereof;

a first non-return valve connectable in said line so as to allow fluid flow only towards said hydraulic motor thereby to move the locking member into the release position and prevent return of the locking member into the lock position;

a second non-return valve connectable in said line so as to allow fluid flow only away from said hydraulic motor thereby to allow the spring to return the locking member into the lock position; and valve operating means adapted for connecting said valves in one of two connections being a first connection wherein said first valve is connected in said line and a second connection wherein said second valve is connected in said line.

2. In a quick-release coupling for connecting a tool in an earth-working machine:

a coupling member adapted for engaging the tool;

a locking member provided on the coupling member and movable between a lock position and a release position for respectively locking the tool to the coupling member and releasing it therefrom;

a spring arranged between the coupling member and the locking member for urging the locking member into one of said lock and release position;

a hydraulic motor arranged between the coupling member and the locking member for moving the locking member into the other one of said lock and release positions in opposition to the force of the spring;

a single fluid flow line connected to said motor for the operation thereof;

a first non-return valve connectable in said line so as to allow fluid flow only toward said hydraulic motor thereby to move the locking member into said one of the lock and release positions and prevent return of the locking member into said other one of the lock and release positions:

a second non-return valve connectable in said line so as to allow fluid flow only away from said hydraulic motor thereby to allow the spring to return said locking member into said other one of the lock and release positions; and valve operating means adapted for connecting said valves in one of two connections being respectively a connection wherein said first valve is connected in said flow line and a connection wherein said second valve is connected in said flow line.

3. The coupling according to claim 2, further comprising a valve member containing both said non-return valves and being supported for movement relative to said flow line between a position in which said first non-return valve is connected in said flow line and a position in which said second non-return valve is connected in said flow line.

4. The coupling according to claim 2, further comprising:

a first valve member containing said first non-return value; and a second valve member containing said second non-return valve;

each said valve member being movable between a position in which the respective non-return valve is connected in said single line and a position in which the respective non-return valve is disconnected from said single line.

5. An earth-working machine adapted for the rapid connection and disconnection of an earth-working tool, the machine comprising:

a coupling member adapted for engaging the tool;

a locking member provided on the coupling member and movable between a lock position and a release position for respectively locking the tool to the coupling member and releasing it therefrom;

a spring arranged between the coupling member and the locking member for urging the locking member into one of said lock and release position;

a hydraulic motor arranged between the coupling member and the locking member for moving the locking member into the other one of said lock and release positions in opposition to the force of the spring;

a source of fluid pressure;

a drain;

a single fluid flow line connected to said motor for the operation thereof;

valve means for connecting said flow line in one of two connections being respectively a connection wherein said flow line is connected to said source and a connection wherein said flow line is connected to said drain;

a first non-return valve connectable in said flow line so as to allow fluid flow only toward said hydraulic motor thereby to move the locking member into said one of the lock and release positions and prevent return of the locking member into said other one of the lock and release positions;

a second non-return valve connectable in said flow line so as to allow fluid flow only away from said hydraulic motor thereby to allow the spring to return said locking member into said other one of the lock and release positions; and valve operating means adapted for connecting said non-return valves in one of two connections being respectively a connection wherein said first valve is connected in said flow line and a connection wherein said second valve is connected in said flow line.

6. The machine according to claim 5, further comprising:

a vehicle; and an arm connected at one end thereof to the vehicle for movement relative thereto, connected at the other end thereof to said coupling member for movement relative thereto, and having said non-return valves mounted thereon;

wherein said valve operating means comprises:

electro-magnetic means provided on said arm for effecting said connections of said non-return valves;

an electric circuit connected between the electro-magnetic means and the vehicle; and switch means provided on the vehicle and connected in said electric circuit for operating said electro-magnetic means.

7. The machine according to claim 6, further comprising:

a second hydraulic motor connected between said arm and said coupling member for effecting said relative movement thereof; and a hydraulic circuit having a flow and return line connected to said second motor for the operation thereof;

said circuit being connected to said source of fluid pressure and to said drain, and said flow line being connected to said flow and return line of said second motor for access to said source and to said drain.

8. A quick-release coupling for connecting a tool in an earth-working machine, the coupling comprising:

a coupling member adapted for engaging the tool;

support structure on which the coupling member is support for movement between operational positions;

a first hydraulic motor adapted for moving said coupling member between said operational positions, said first hydraulic motor including a cylinder containing a piston movable therein between terminal positions;

a locking member provided on the first coupling member and movable between a lock position and a release position for respectively locking the tool to the coupling member and releasing it therefrom;

a spring arranged between the first coupling member and the locking member for urging the locking member into one of the lock and release positions; and a second hydraulic motor arranged for moving the locking member into the other one of the lock and release positions in opposition to the force of said spring;

said second hydraulic motor being arranged for moving said locking member into said other one of the lock and release positions responsive to fluid pressure in the first hydraulic motor reaching a predetermined value, said predetermined value being reached when said piston attains one of said terminal positions.

9. An earth-working machine adapted for the rapid changing of an earth-working took, the machine comprising:

a coupling member adapted for engaging the tool;

a locking member provided on the coupling member and movable between a lock position and a release position;

a spring arranged between the coupling member and the locking member for urging the locking member into one of the lock and release positions;

a second hydraulic motor provided on the coupling member for moving the locking member into the other one of said lock and release positions in opposition to the force of the spring;

a source of fluid pressure;

a hydraulic circuit including a first fluid flow line and a reversing valve for controlling flow through said flow line toward and from said first hydraulic motor for moving said first coupling member into and from one of said operating positions;

a second fluid flow line connected between said first flow line and second motor for moving said locking member;

a first non-return valve connectable in said second flow line so as to allow fluid flow through said second flow line only toward said second motor;

a second non-return valve connectable in said second flow line so as to allow fluid flow through said second flow line only away from said second motor; and valve operating means adapted for connecting said valves in one of two connections being respectively a connection wherein said first valve is connected in said second flow line and a connection wherein said second valve is connected in said second flow line.

10. The machine according to claim 9, said first hydraulic motor including a cylinder containing a piston movable in said cylinder between terminal positions;

said hydraulic circuit containing a pressure relief valve for limiting the pressure in said circuit to a maximum value attainable when the piston reaches one of said terminal positions; and said second hydraulic motor being adapted to overcome the force of said spring and move said locking member into said one of the lock and release positions responsive to said pressure attaining said maximum value.

11. The machine according to claim 9, further comprising:

a vehicle; and an arm pivotally connected at one end thereof to the vehicle and at the other end thereof to said coupling member, and having said first cylinder and said non-return valves mounted thereon;

wherein said valve operating means comprises:

electro-magnetic means provided on said arm for operating said non-return valves;

an electric circuit connected between the electro-magnetic means and the vehicle; and switch means provided on the vehicle and connected in said electric circuit for operating said electro-magnetic means.

* * * * *

UNITED STATES PATENT AND TRADEMARK OFFICE

CERTIFICATE OF CORRECTION

PATENT NO. : 5,110,254

DATED : May 5, 1992

INVENTOR(S) : Martin J. AUBREY

It is certified that error appears in the above-identified patent and that said Letters Patent is hereby corrected as shown below:

Column 4, line 49, change "member;" to --member--.

Column 5, line 41, change "54A" to --54B--.

Column 7, line 61, change "position;" to --positions;--.

Column 8, line 38, delete "adapted";

line 45, change "position;" to --positions;--.

Column 9, line 43, change "support" to --supported--.

Column 10, line 4, change "took," to --tool,--;

line 6, delete "adapted";

between lines 6 and 7, insert the following paragraph:

--a first hydraulic motor for moving the coupling member between operational positions;--;

line 24, change "and second" to --and said second--.

Signed and Sealed this

Eighth Day of November, 1994

*Attest:*

*Attesting Officer*

Bruce Lehman

BRUCE LEHMAN

*Commissioner of Patents and Trademarks*